United States Patent [19]

Bonse

[11] 4,180,533

[45] Dec. 25, 1979

[54] CARBURETOR FOR INTERNAL COMBUSTION ENGINES

[75] Inventor: Michael Bonse, Dusseldorf, Fed. Rep. of Germany

[73] Assignee: Societe Industrielle de Brevets et d'Etudes S.I.B.E., Neuilly sur Seine, France

[21] Appl. No.: 871,540

[22] Filed: Jan. 23, 1978

[30] Foreign Application Priority Data

Feb. 8, 1977 [FR] France ..... 77 03487

[51] Int. Cl.[2] ..... F02M 1/06

[52] U.S. Cl. ..... 261/39 A; 123/179 G; 123/179 T; 261/39 D

[58] Field of Search ..... 261/39 D, 39 A; 123/179 G, 179 T

[56] References Cited

U.S. PATENT DOCUMENTS

| | | | |
|---|---|---|---|
| 1,750,766 | 3/1930 | Stokes | 123/180 T |
| 1,904,936 | 4/1933 | Stokes | 261/39 D |
| 2,093,218 | 9/1937 | Thieulin et al. | 261/39 D |
| 3,246,886 | 4/1966 | Goodyear et al. | 261/39 D |
| 3,810,606 | 5/1974 | Masaki | 261/39 A |
| 3,877,448 | 4/1975 | Schmid | 261/39 D |
| 3,934,571 | 1/1976 | Mennesson | 261/39 A |

FOREIGN PATENT DOCUMENTS

| | | | |
|---|---|---|---|
| 2514722 | 8/1976 | Fed. Rep. of Germany | 261/39 D |
| 2610934 | 10/1976 | Fed. Rep. of Germany | 261/39 D |
| 673537 | 1/1952 | United Kingdom | 123/180 T |

*Primary Examiner*—Tim R. Miles

*Attorney, Agent, or Firm*—Stevens, Davis, Miller & Mosher

[57] ABSTRACT

A carburetor for an internal combustion engine has an auxiliary starting device for delivering fuel and air to the induction passage during starting and cold running. The starting device comprises a duct opening into the induction passage downstream of the throttle means receiving fuel and air, and provided with a closure valve opened until the temperature of the engine has reached a first predetermined value. The flow of fuel entering the duct is reduced upon the engine becoming self operative. A flap located in the induction passage upstream of the opening of the main fuel delivery system is biased toward opening by the air flow around it and is resiliently biased toward closure with a force which decreases as the temperature of the engine increases.

8 Claims, 2 Drawing Figures

CARBURETOR FOR INTERNAL COMBUSTION ENGINES

BACKGROUND AND SUMMARY OF THE INVENTION

The invention relates to carburetor for internal combustion engines of the kind which comprises operator actuatable main throttle means located in the induction passage, downstream of the delivery opening of a main fuel delivery system, and an auxiliary starting device for delivering an additional flow of fuel and air to the induction passage during starting and cold running, said starting device comprising duct means opening into the induction passage downstream of the throttle means receiving fuel and air, and provided with a closure valve, temperature sensitive means for maintaining said closure valve in open condition until the temperature of the engine has reached a first predetermined value, a flap located in said induction passage upstream of the opening of the main fuel delivery system, said means being arranged to be biased toward opening by the air flow around it, return means for resiliently biasing the flap toward closure, with a force which decreases as the temperature of the engine increases.

It has already been proposed (French Pat. No. 2 180 160 and U.S. Pat. No. 3,934,571) to combine a closure or distributing valve and a choke flap in a starting device. The flap is placed in the induction passage upstream of the opening of the main delivery system and is unbalanced so that it tends to open under the action of the air stream through the induction passage against the action of return means whose effect on the flap decreases in proportion as the engine warms up. The effect of the flap is to increase the depression or vacuum at the opening of the delivery system and consequently to increase the richness of the air/fuel mixture admitted to the engine, as long as the engine has not reached a predetermined temperature. While that flap provides considerable enrichment when the engine is loaded by opening the main throttle means, it has the disadvantage of lack of accuracy as regards the richness of the mixture supplied to the engine. Furthermore, a starting device combining a distributing valve and a choke valve is complex since it requires elements of both a conventional choke flap and a distributing circuit.

It is an object of the invention to provide a carburetor comprising a starting device which supplies the engine with an appropriate amount of air and fuel under all starting conditions, while it remains relatively simple.

According to an aspect of the invention, there is provided a carburetor of the above-defined kind, wherein the flap is associated with means preventing it from closing beyond a predetermined partially open position, and the closure valve is associated with means which reduce the quantity of fuel flowing in the duct as soon as the engine runs by itself.

According to another aspect, the flap is associated with temperature responsive means preventing it from closing beyond a minimum position variable between a predetermined partially open position when the engine is cold and a fully open position when the engine temperature exceeds a second value. Thus the only function of the flap (in contrast to prior art flaps) is to enrich the mixture supplied to the cold engine, but only when the engine is under load. It can be seen that:

During cranking to start the engine, the distributing valve disposed in a duct receiving a sufficient supply of air and fuel provides the required high richness.

During idling of the engine when cold (running without load), the richness is also determined only by the distributing valve.

When the cold engine is loaded by opening the main throttle means, enrichment is provided both by the distributing valve and by the flap (which ceases to have an appreciable effect at a temperature at which the distributing valve is usually not completely closed).

Finally, when the engine is at its normal operating temperature, the starting device ceases to act on the richness of the mixture.

The flap is typically biased in the closing direction by a temperature sensitive element, subjected to the engine temperature, which may be the same as that controlling the distributing valve. Advantageously the valve is placed in a duct supplied with an air-fuel mixture having a richness which first decreases as soon as the engine is self operating and further decreases after a time period (which may be approximately constant or vary inversely with ambient temperature) after the engine starts.

The invention will be better understood from the following description of a downdraught carburetor constituting a non-limitative embodiment thereof.

DETAILED DESCRIPTION OF A PREFERRED EMBODIMENT

Figure 1:
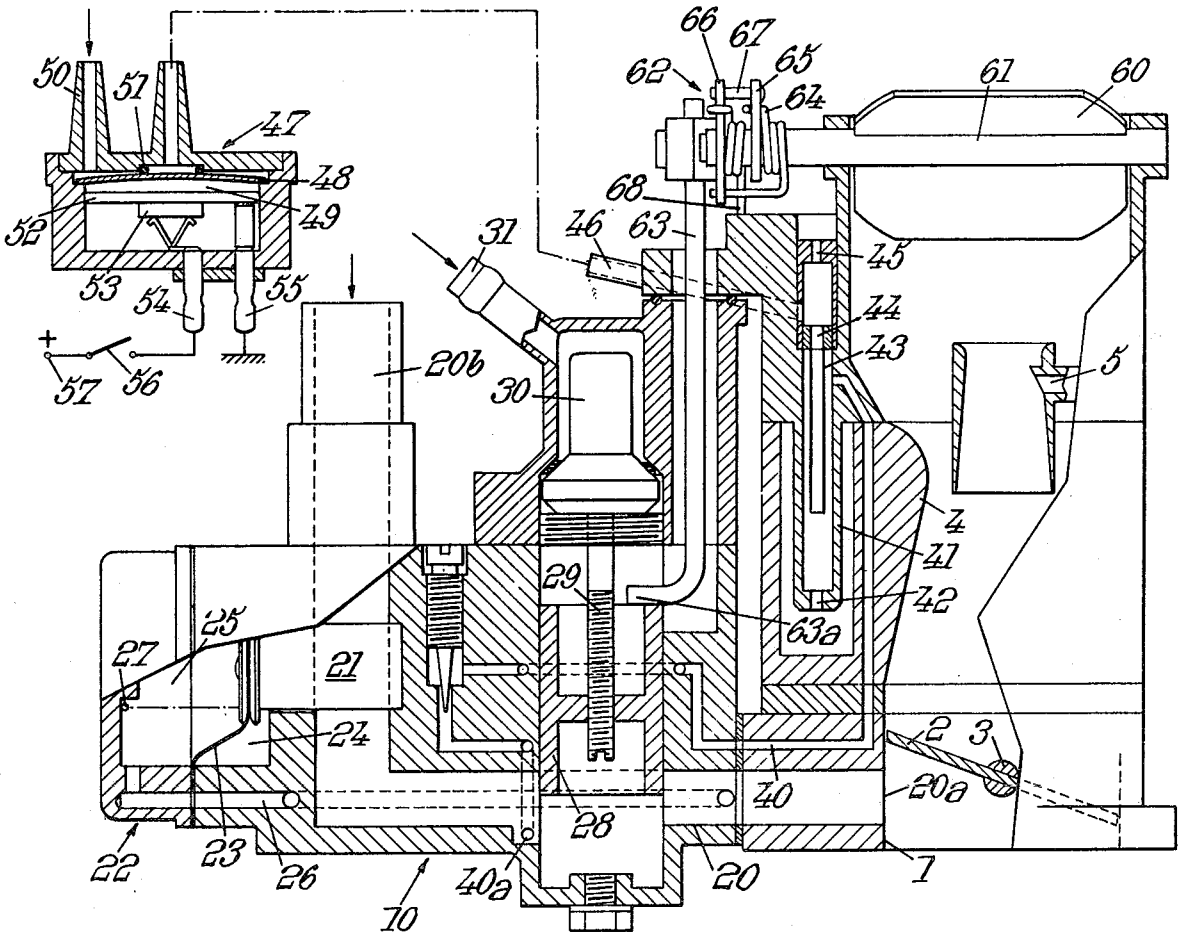
FIG. 1 is a diagrammatic cross-section of the carburetor, the elements being shown in the positions corresponding to a cold engine at rest.
Figure 2:
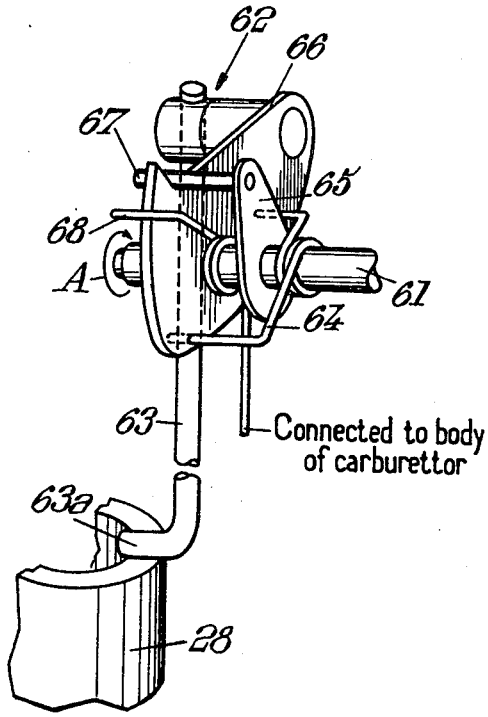
FIG. 2 is an isometric view on an enlarged scale of a part of the carburetor shown in FIG. 1.

Referring to FIG. 1, there is shown a carburetor which comprises a housing formed with an induction passage 1. A main throttle is disposed in the passage and comprises a butterfly 2 secured to a shaft 3 and disposed downstream of a venturi 4 into which a main fuel delivery system 5 opens. Butterfly 2 can be actuated by the operator via a linkage (not shown). In contrast to most conventional carburetors comprising a choke flap, the carburetor shown does not comprise a fast idle cam for preventing the butterfly from completely closing when the engine is cold.

The starting and cold-running system comprises a distributing circuit having a closure valve 10 disposed in a duct 20 supplying an air-fuel mixture and opening via an orifice **20*a* into that part of passage 1 situated downstream of butterfly 2. The duct is supplied by an additional air circuit and by a circuit delivering a rich fuel emulsion. In the illustrated embodiment, valve 10 comprises a sliding member 28 slidable in the wall of duct 20 transversely to the duct and operatively connected to the movable rod 29 of a temperature-sensitive element 30. Element 30 comprises a closed capsule containing a substance which expands when the temperature increases and moves rod 29 outwardly. Element 30 is subjected to a temperature representing the operating condition of the engine, e.g. the temperature of the engine cooling water, which is admitted through a connection such as 31. When the engine is cold, slidable member 28 leaves duct 20 open. When the engine warms up, the movable rod 29 moves member 28 in the direction for closing duct 20. Member 28** begins to throttle the duct when the temperature reaches a predetermined value, and completely closes it at and above another predetermined temperature $t_1$.

Duct 20 is prolonged upstream of slide member 28 by a duct 20*b* connected upstream to an air filter (not shown) protecting the carburetor air inlet. Means for controlling the flow cross-section in duct 20*b* comprises a plunger 21 coupled to a diaphragm 23 of a pneumatic element 22 and sliding across the wall of duct 20. Diaphragm 23 separates two chambers 24, 25 in the housing of element 22. Chamber 24 is at atmospheric pressure whereas chamber 25 (the working chamber) is connected by a pipe 26 to that part of passage 1 downstream of butterfly 2. If there is no vacuum in passage 1, a spring 27 disposed in chamber 25 forces plunger 21 into a position in which it closes duct 20.

The circuit for supplying a rich air-fuel emulsion comprises a supply duct 40 opening via an orifice 40*a* into that part of duct 20*b* immediately upstream of sliding member 28. The upstream part of duct 40 is connected to a well 41, the bottom part of which is connected by a calibrated orifice 42 to receive fuel from the constant-level chamber (generally a float chamber) of the carburetor. An emulsion tube 43 projects into well 41. Tube 43 is supplied with air through a calibrated orifice 44. The air is provided partly by a fixed calibrated orifice 45 having a flow cross-section less than that of calibrated orifice 44 and connected to the carburetor air inlet, and partly via a line 46 having a large flow cross-section compared with the calibrated orifices 44 and 45. Line 46 can be opened or closed by a thermal timing valve 47. The closure means of valve 47 is a bimetallic disk 48 having a curvature which reverses when its temperature exceeds a predetermined limit value. Disk 48 is placed in a recess 49 and, when subjected to a temperature below that limit value (e.g. 40° C.) separates line 46 from a pipe 50 connected to atmosphere. In that case, disk 48 has the shape illustrated in the drawing and shuts off duct 46 by seating against a sealing O-ring 51. When the temperature rises above the limit value, the disk curvature reverses, thus connecting line 46 to atmosphere via chamber 49 and pipe 50.

Chamber 49 is bounded by a heat-conducting typically metallic component 52 provided with heating means, such as a resistor 53 having a positive temperature coefficient or PTC. As is known a PTC has a resistance which is almost constant below a "switch" temperature but increases abruptly and considerably when the "switch" temperature is exceeded.

The PTC 53 is chosen so that its "switch" temperature is considerably above the ambient temperatures during normal operating conditions of the engine. The PTC may comprise a pellet of ceramic material containing barium titanate and having a "switch" temperature of approx. 100° C. One surface of resistor 53 is, e.g. secured to component 52 by an adhesive conducting heat and electricity. The electric source of the PTC heating circuit can be the car battery, connected to terminals 54 and 55. Switch 56 is of a type which closes as soon as the engine is self running. It closes, e.g. as soon as the voltage of an electric generator driven by the engine exceeds a given value.

The starting device further comprises a valve 60 for enrichment when the engine is loaded. Valve 60 is eccentrically mounted on a rotatable shaft 61 and placed in passage 1 upstream of the opening of the main fuel delivery system 5. The minimum opening position of valve 60 is controlled in accordance with the position of sliding member 28 by a resilient semi-positive connection 62. The free, curved end 63*a* of a rod 63 bears on sliding member 28 so that when sliding member 28 moves upwards it tends to close valve 60. Resilient connection 62 comprises a helical spring 64 stretched between a washer 65 secured to shaft 61 and a lever 66 rotatably mounted on shaft 61 and carrying rod 63. Spring 64 tends to hold lever 66 against a finger 67 secured to washer 65. A return spring 68 holds end 63*a* against the edge of sliding member 28. At the predetermined minimum starting temperature valve 60 should be slightly open, like a conventional choke flap immediately after the cold engine starts. Accordingly, an abutment (not shown) is provided, or rod 63 is given a suitable length.

The device operates as follows, when the cold engine is started and then warms up.

Before the cold engine starts, the various components of the starting device are in the position shown in the drawing. During starter operation, the relatively weak depression in passage 1 downstream of butterfly 3 is applied with maximum efficiency to the duct 40 supplying the air-fuel mixture, at which time the following components are closed: butterfly 3, air duct 20*b* (by piston 21) and duct system 43 for aerating the air-fuel mixture (by the bimetallic disk 48).

Capsule 30 holds sliding member 28 at the top position and rod 63 holds valve 60 slightly open, in its minimum open position. As long as butterfly 2 is closed, no appreciable depression occurs in the main fuel jet system 5, but only distributor 10 supplies the engine with the rich mixture required for starting.

As soon as the engine is self-running, the increased depression transmitted by pipe 26 opens duct 20*b* via pneumatic element 22 and consequently produces a first reduction in the richness of the air-fuel mixture fed to the engine. Valve 60 has not yet come into action, since butterfly 2 is closed.

When the engine starts, contact 56 closes and consequently bimetallic disk 48 is heated by PTC 53. After a certain time, which depends on the characteristics of PTC 53 but also on the ambient temperature, the curvature of the bimetallic disk reverses, so that duct system 46 becomes open to atmosphere. This reduces the effect of the depression in induction passage 1 downstream of butterfly 2 on the mixing circuit via duct 40, resulting in a second reduction in the richness of the air/fuel mixture supplied to the engine.

If, while the distributing valve 10 is open, butterfly 2 is opened to load the engine, the depression on the outlet orifice 20*a* of the distributor circuit decreases, together with the amount of air-fuel mixture supplied to this circuit. On the other hand, the depression is transmitted to that part of the intake manifold between butterfly 2 and valve 60. Since valve 60 is in its minimum open position, the depression remains high in the aforementioned part of the duct, and fuel is sucked from the main fuel jet system 5, thus making up the deficiency in the amount of air/fuel mixture supplied by the distributor circuit 10.

In proportion as the engine warms up, the movable rod 29 of capsule 30 moves downwards, drawing slide 28 with it, which has two consequences. Firstly, slide 28 progressively closes duct 20. Secondly, rod 63 follows the motion of slide 28 downwards, in the drawing, and valve 60 progressively opens. Thus, during the opening of butterfly 2, valve 60 has an increasingly weaker effect, at the same time as the effect of the distributor circuit decreases.

As soon as the capsule temperature reaches a value $t_2$, rod 63 abuts the casing in a position at which valve 60 is open and no longer has an effect. At a temperature above $t_1$, slide 28 closes duct 20, so that at the normal engine operating temperature the distributor circuit no longer supplies the rich mixture required during the warming-up.

The mixture has also been made leaner by the action of valve 47, which opens before the temperature $t_1$ has been reached, usually a few seconds after the engine is rotating by itself.

As can be seen, the invention provides an advantageous distribution of the functions performed by a distributor circuit and a valve or flap. The only purpose of the flap is for enrichment under load, which means that we can omit both the normal butterfly opening device, such as a fast idling cam, required when the flap is used for starting the engine, and the pneumatic means for opening the flap and adapted to reduce the richness of the mixture supplied to the engine immediately after the engine starts. The resulting system is simple and provides suitable richness under the various engine operating conditions when cold, including the phases when the engine is loaded.

I claim:

1. A carburetor for an internal combustion engine, having:

an induction passage, operator actuatable main throttle means in said induction passage, a main fuel delivery system opening into said induction passage upstream of said throttle means, and an auxiliary starting device for delivering an additional flow of fuel and air to the induction passage during starting and cold running, said starting device comprising:

duct means opening into the induction passage downstream of the throttle means, means for supplying fuel and air to said duct means, a closure valve in said duct, temperature responsive means for maintaining said closure valve in open condition until the temperature of said engine has reached a first predetermined value, means, separate from the temperature responsive means, for decreasing the flow of fuel entering said duct means upon the engine becoming self operative, a flap located in said induction passage upstream of the opening of the main fuel delivery system, said flap being arranged to be biased toward opening by the air flow around it, return means for resiliently biasing the flap toward closure, with a force which decreases as the temperature of the engine increases, and variable temperature-responsive stop means associated with the flap and preventing it from moving toward closure beyond a position of partial opening even under cold-start conditions.

2. A carburetor according to claim 1, wherein the closure valve is placed in a duct supplied by an additional air circuit and by a duct supplying a rich air/fuel mixture, and the additional circuit has a further valve which is normally closed and is open when the depression downstream of the main throttle means exceeds a predetermined value reached as soon as the engine is self operative.

3. A carburetor according to claim 2, comprising two air paths from atmosphere to said duct for supplying a rich mixture, one of said paths comprising a calibrated restriction and the other of said paths comprising a timing valve, said timing valve being of a type initially at rest and arranged to open a predetermined time after the engine is started.

4. A carburetor according to claim 2, further comprising a thermostatic capsule, and the closure valve has a movable part operatively associated with said thermostatic capsule arranged to move said movable part into closed position when the temperature of the engine exceeds a predetermined value.

5. A carburetor according to claim 4, further comprising spring means, said stop means comprises a linkage in abutting connection with said movable part whereby it is forcibly moved by said movable part in a predetermined direction against the return force of said spring means upon heating of the engine and modifies the minimum opening position of said flap.

6. A carburetor according to claim 5, wherein the linkage comprises a rod forcibly retained in contact with said movable part by said spring means and said resilient return means which is stressed between said linkage and said flap for biasing the flap toward closure by an extent limited by said stop means.

7. A carburetor for an internal combustion engine, having:

an induction passage, operator actuatable main throttle means in said induction passage, a main fuel delivery system opening into said induction passage upstream of said throttle means, and an auxiliary starting device for delivering an additional flow of fuel and air to the induction passage during starting and cold running, said starting device comprising:

duct means opening into the induction passage downstream of the throttle means, means for supplying fuel and air to said duct means, a closure valve in said duct, temperature responsive means for maintaining said closure valve in open condition until the temperature of said engine has reached a first predetermined value, a flap located in said induction passage upstream of the opening of the main fuel delivery system, said means being arranged to be biased toward opening by the air flow around it, return means for resiliently biasing the flap toward closure, with a force which decreases as the temperature of the engine increases, stop means responsive to the temperature of the engine, associated with the flap and preventing it from moving toward closure beyond a minimum opening position, and progressively varying said minimum opening position from a predetermined position when the engine is cold to a fully open position when said temperature of the engine exceeds a second predetermined value.

8. A carburetor according to claim 7, further comprising means for decreasing the flow of fuel entering said duct means upon the engine becoming self operative.

* * * * *